United States Patent [19]

Schön

[11] Patent Number: 4,894,140

[45] Date of Patent: Jan. 16, 1990

[54] METHOD OF TREATING WASTE OIL

[76] Inventor: Christian O. Schön, Römerstrasse 1, D-7590 Achern 18, Fed. Rep. of Germany

[21] Appl. No.: 116,856

[22] Filed: Nov. 4, 1987

[30] Foreign Application Priority Data

Nov. 12, 1986 [DE] Fed. Rep. of Germany ..... 3638606
Feb. 3, 1987 [DE] Fed. Rep. of Germany ..... 3703110

[51] Int. Cl.[4] ..... C10G 9/14; C10G 51/02; C10M 1/75

[52] U.S. Cl. ..... 208/72; 208/67; 208/92; 208/106; 208/132; 208/179; 208/184; 203/DIG. 6; 202/237

[58] Field of Search ..... 208/179, 184, 106, 72, 208/132, 100, 97, 75, 67, 92; 134/22.11, 22.12; 202/237; 203/DIG. 6

[56] References Cited

U.S. PATENT DOCUMENTS

| | | | |
|---|---|---|---|
| 1,952,639 | 3/1934 | Thiele | 208/184 |
| 3,173,859 | 3/1965 | Chambers | 208/184 |
| 3,722,184 | 3/1973 | McMinn | 208/184 |
| 3,919,076 | 11/1975 | Cutler et al. | 208/179 |
| 3,922,216 | 11/1975 | Wilson et al. | 208/72 |
| 3,954,602 | 5/1976 | Troesch et al. | 208/179 |
| 4,053,006 | 10/1977 | Tkac et al. | 202/236 |
| 4,333,822 | 6/1982 | Tkac et al. | 208/184 |
| 4,334,952 | 6/1982 | Tkac et al. | 208/173 |
| 4,361,478 | 11/1982 | Gengler et al. | 208/132 |
| 4,551,233 | 11/1985 | Blauwhoff et al. | 208/72 |
| 4,666,587 | 5/1987 | Martin | 208/181 |

*Primary Examiner*—Anthony McFarlane
*Attorney, Agent, or Firm*—Peter K. Kontler

[57] ABSTRACT

Waste oil is treated in a tubular reactor having a length of up to and in excess of 2 km in a plurality of stages each of which involves heating the product to a different temperature and maintaining the product at a different pressure. The released fractions are evacuated from the path for the flow of waste oil and are immediately condensed and distilled to yield a variety of products from oil having a low boiling point to coke. One or more withdrawn fractions can be treated (for example, hydrogenated) in one or more discrete tubular reactors. The heating can involve raising the temperature of waste oil to several times the critical cracking temperature, and the regulation of pressure can involve a reduction of pressure to less than 1 mbar. The last stage of the reactor can be cleaned by abrasive particles, by vibration at high frequencies and/or by acceleration of the conveyed stream to an elevated speed.

27 Claims, 3 Drawing Sheets

METHOD OF TREATING WASTE OIL

BACKGROUND OF THE INVENTION

The invention relates to improvements in methods of and apparatus for treating waste oil and other long-chain compounds of high molecular weight including pyrolysis oil (hereinafter referred to only as waste oil). More particularly, the invention relates to improvements in methods of and apparatus for treating waste oil wherein waste oil is treated in a continuous operation including heating, fractionating and distilling to obtain a variety of products of different qualities and compositions. Still more particularly, the invention relates to improvements in methods of and apparatus for treating waste oil in such a way that the treated material yields a plurality of side stream fractions and that the path for the flow of waste oil during treatment is kept free of deposits, such as coke and others.

Heretofore known treatments of waste oil involve multistage distilling operations including conveying of waste oil through heated tubes and heating of waste oil in other types of heat exchanger means to a temperature of approximately 300° C. prior to processing of heated waste oil in large-capacity reaction columns. The arrangement is or can be such that a first stage involves a treatment at atmospheric pressure, and a following second stage involves a treatment below atmospheric pressure. The residues can be removed by distillation in a third stage at less than atmospheric pressure. One of the just outlined methods is known as sulfuric acid-bleaching earth process. A drawback of such methods is that the period of dwell of waste oil in the apparatus is very long. Moreover, and since the receptacles for waste oil are very large, it is difficult to control the temperature and the pressure with a requisite degree of accuracy. As a rule, pressures to which waste oil is subjected in such apparatus cannot be reduced to less than approximately 60–100 mbar. Therefore, it is often necessary to operate at very high temperatures, depending on the boiling points and evaporation temperatures of certain fractions. In many instances, the temperatures are only slightly below the cracking temperature of waste oil. On the other hand, cracking of the treated compound must be avoided in order to ensure that such compound will retain its satisfactory lubricating characteristics.

Another drawback of conventional methods and apparatus is that they yield large quantities of acid tar and bleaching earth which is undesirable for ecological reasons. The cost of waste disposal is quite high because the yield normally does not exceed 60% and approximately 20% of treated compound consists of acid tar which must e disposed of at a substantial cost. The remaining 20% of the admitted material is removed in the form of water vapors.

In order to avoid the drawbacks of the above outlined conventional methods and apparatus, certain more recent proposals involve the utilization of thin film evaporators. Attempts to further develop such treatment of waste oil involve the utilization of super critical gases. However, this entails a huge initial and maintenance cost. Moreover, and since such methods are designed for the treatment of rather large volumes of waste gas under circumstances when the treated material is readily ignitable, the danger of explosion and fire is ever present. This, in turn, involves additional outlays for the reasons of safety. Furthermore, the apparatus for the practice of such method must be designed to stand elevated pressures of up to 150 bars.

OBJECTS AND SUMMARY OF THE INVENTION

An object of the invention is to provide a novel and improved method of treating waste oil and analogous compounds of high molecular weight which renders it possible to recover a high percentage of valuable fractions in a simple and inexpensive way.

Another object of the invention is to provide a method which renders it possible to complete the treatment in a small area and within a short interval of time.

A further object of the invention is to provide a method which can be practiced at relatively low temperatures and at low pressures and in such a way that the danger of combustion and/or explosion is minimal.

An additional object of the invention is to provide a method which renders it possible to recover a large number of fractions each of which exhibits optimum characteristics and can be readily processed for reuse or disposal.

Still another object of the invention is to provide a novel and improved apparatus for the practice of the above outlined method and to construct and assemble the apparatus in such a way that it can continuously process a flow of waste oil or an analogous compound in a small area and with the consumption of small quantities of energy for heating, cooling, pressurizing, reduction of pressure, distilling and other operations.

A further object of the invention is to provide the apparatus with novel and improved means for conveying the compound along a selected path.

Another object of the invention is to provide the apparatus with novel and improved means for reducing the pressure in the path for the treated compound and with novel and improved means for preventing the deposition of coke and/or other solid substances along the surfaces bounding the path for the treated compound.

An additional object of the invention is to provide the apparatus with novel and improved means for accelerating the flow of waste oil or another treated compound along its path.

One feature of the present invention resides in the provision of a method of continuously treating waste oil and analogous flowable compounds of high molecular weight. The method comprises the steps of conveying the compound from a source along a single elongated path in a tubular or one-pipe reactor, heating the compound to progressively higher temperatures in a plurality of successive portions of the path, maintaining the compound at a predetermined pressure and at a predetermined speed in each portion of the path so that the compound yields a succession of fractions as a result of heating, (positive or negative) pressurization and period of dwell (this period depends upon the speed of the compound) in at least some of the path portions, withdrawing the fractions at the downstream ends of the respective portions of the path, and immediately (i.e., without intermediate storage) processing the withdrawn fractions.

The maintaining step can include reducing the pressure in successive portions of the path. The pressure can be reduced down to approximately 1 mbar.

At least one of the processing steps can include hydrogenating the respective fraction within a temperature range of 200–450° C. (preferably 250–350° C.) and at a pressure of 100–300 bars.

The heating step can include establishing in the last portion of the path a temperature within the range of 300–900° C., and the maintaining step of such method can include keeping the compound in the last portion of the path at a pressure of 1 mbar to 10 bars, for example, at or close to atmospheric pressure.

If the compound is waste oil, the method can further comprise the step of injecting waste oil into the foremost portion of the path so that the oil is admitted in atomized condition.

The method can comprise the additional steps of admitting the compound into the first or foremost portion of the path at a first speed, conveying the thus admitted compound in at least one intermediate portion of the path at a higher second speed, and maintaining the compound in the intermediate portion of the path at a temperature of 325–900° C. If the compound is waste oil, its cracking temperature is in the range of 300–320° C., i.e., below the aforementioned range of 325–800° C. The one intermediate portion is then followed by at least one portion of the path wherein the conveyed oil does not yield any fractions.

If the compound is waste oil, it can be dehydrated in at least one portion of the path and is thereafter heated in another portion of the path to a temperature of approximately 800° C. (such heating preferably takes place gradually within the other portion of the path). The oil is accelerated to an elevated speed (e.g., all the way to the speed of sound) in the other portion of the path, and its temperature is thereupon abruptly reduced to a value below the critical cracking temperature to thus obtain a plurality of fractions. The processing step of such method includes recovering the fractions seriatim at corresponding boiling points and vapor pressures.

The accelerating step in at least one portion of the path can include pumping the compound into the path at an elevated pressure and/or drawing the compound through at least one portion of the path by suction and/or recirculating gaseous and/or liquid constituents of the compound and/or preventing expansion of the compound which is heated so that it is at least partially vaporized and tends to expand.

The compound can be mechanically conveyed in at least one intermediate portion of the path.

If the compound requires abrupt cooling, this can be accomplished by placing a cooled barrier across at least one portion of the path so that the compound impinges upon and is abruptly cooled by the barrier.

It is often necessary to internally clean the reactor so as to relieve its internal surface of deposits which settle thereon and adhere thereto as the treatment of a continuous flow of a compound progresses. The cleaning step can include admitting into the compound at least one abrasive non-coking ingredient so that the flowing compound entrains the introduced ingredient along a selected stretch of the path (e.g., along the last portion or portions of the path). Such method can further comprise the step of regulating the cleaning step including varying the speed of the compound to thereby intensify or lessen the abrasive action of the ingredient. Such regulating step can further comprise monitoring the percentage of abraded deposits in the compound (e.g., with a Geiger counter), and influencing the varying step as a function of the monitored percentage of abraded deposits.

The method can further comprise the step of vibrating the reactor and/or the conveyed compound within a frequency range including the resonance frequency.

Still further, the method can include adding to the compound at least one chemical treating agent (such as hydrogen or sodium) in at least one portion of the path.

The heating step can include placing a jacket around a portion of or around the entire tubular reactor and admitting into the jacket a non-aggressive gaseous heating fluid.

Another feature of the invention resides in the provision of an apparatus for continuously treating waste oil and analogous flowable compounds of high molecular weight. The apparatus comprises a source of supply of a compound having a high molecular weight, an elongated tubular or one-piece reactor defining an elongated path having a plurality of portions including a foremost portion, a plurality of intermediate portions and a last portion, means for continuously conveying the compound from the source into the foremost portion of the path, means for heating the compound to different temperatures in at least some portions of the path, means for maintaining the compound at different pressures in at least some portions of the path whereby the compound yields different fractions in at least some portions of the path, and means for processing the fractions including separator means and condenser means for the fractions. The processing means preferably includes means for withdrawing the fractions at the downstream ends of the respective portions of the path. The processing means can also include at least one tubular or one-pipe side stream reactor having an inlet connected to one of the separator means.

The heating means can comprise a jacket which surrounds at least a part of the reactor and means for admitting a heat exchange medium between the jacket and the reactor.

The reactor preferably comprises at least two sections having different cross-sectional areas. For example, the cross-sectional area of the path can increase in one or more portions of the path in the direction of flow of the compound in the reactor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
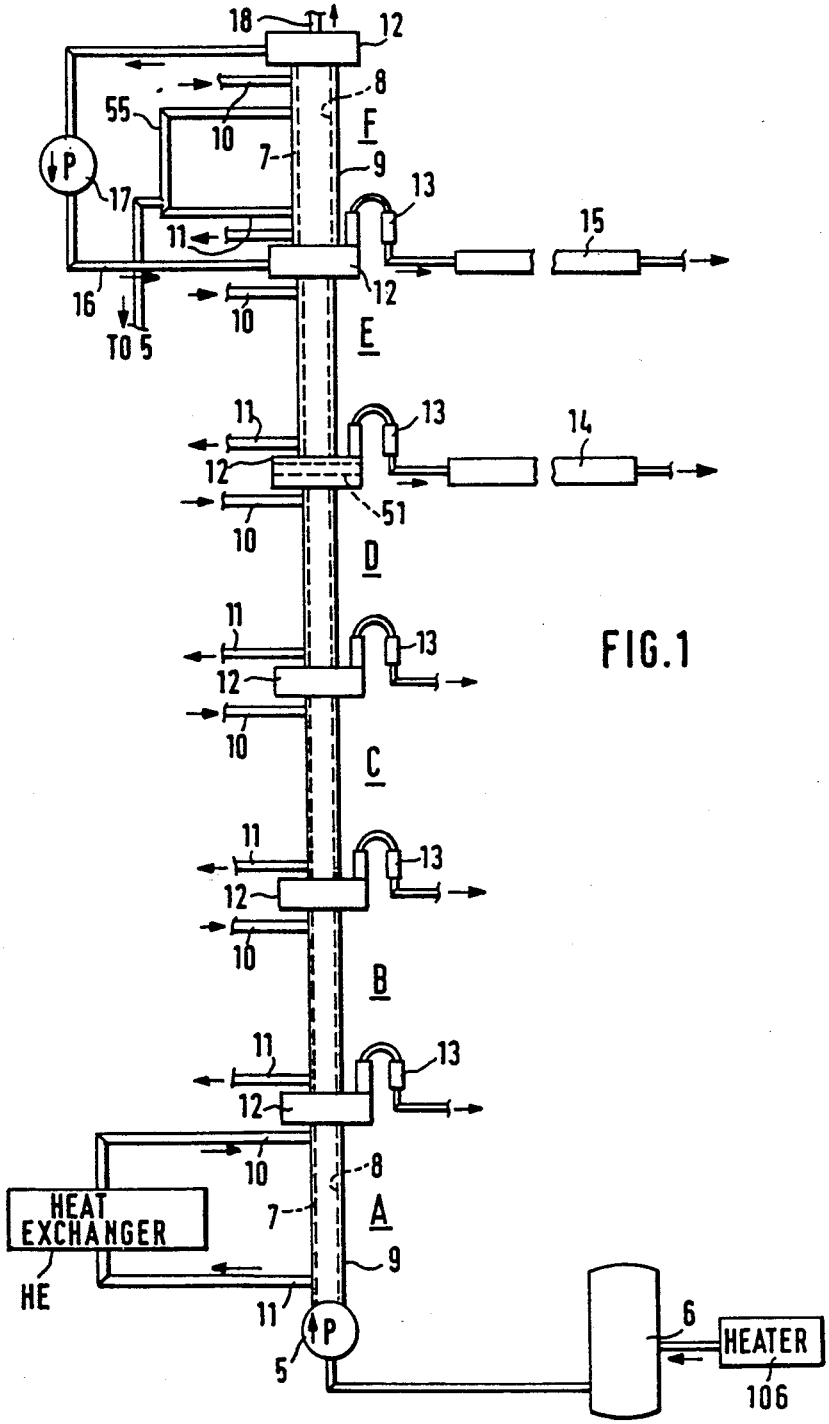
FIG. 1 is a schematic view of an apparatus which embodies one form of the invention and whose reactor has six stages.
Figure 3:
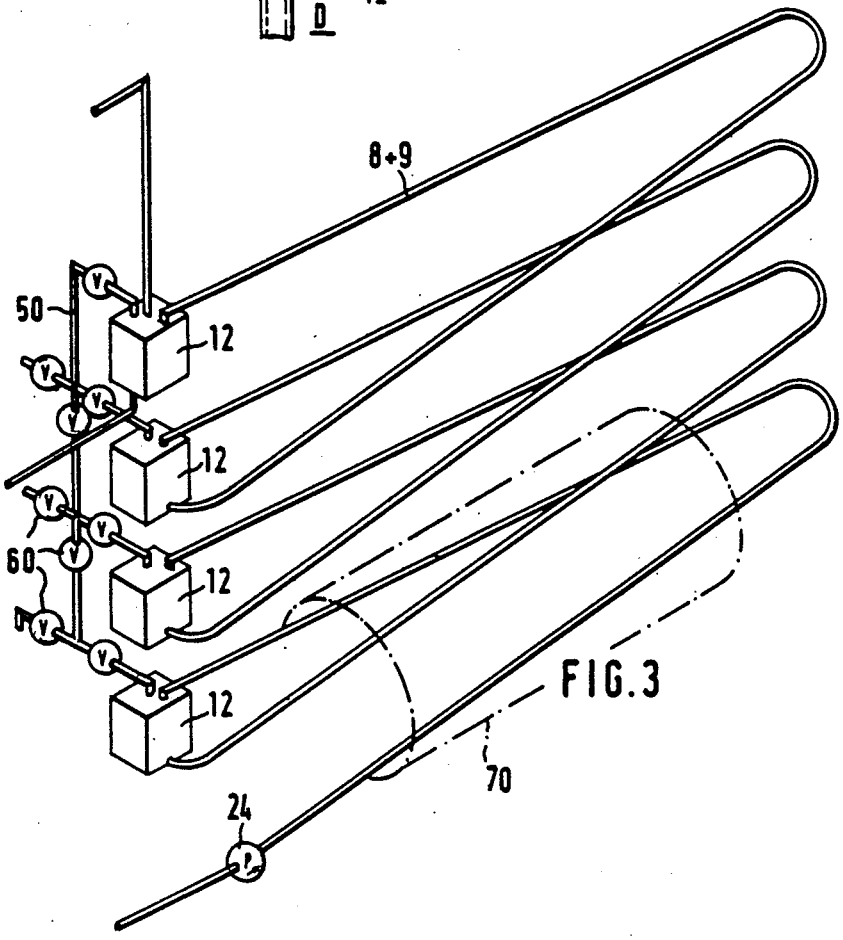
FIG. 3 is a schematic perspective view of a portion of the apparatus of FIG. 1, showing the manner in which the reactor is or can form a series of loops at different levels.

Referring first to FIGS. 1 and 3, there is shown a one-pipe or tubular reactor 8 which can have a length of one or more kilometers (e.g., between 1000 and 2000 meters) and preferably forms a plurality of cascading loops disposed at different levels. The ratio of the diameter of the reactor 8 to its length can be in the range of 1:700 to 1:20,000. The inner diameter of the reactor 8 is preferably between 10 and 500 mm, most preferably between 80 and 150 mm.

The reactor 8 which is shown in FIG. 1 has six successive stages A to F, i.e., the elongated path which is defined by the reactor has six successive portions including a foremost portion (stage A), four intermediate portions (stages B-E) and a last portion (stage F). The source of supply of a compound (e.g., waste oil) which requires treatment is a tank 6 or another suitable vessel, and the means for conveying a continuous flow of waste oil from the tank 6 into the first portion of the path which is defined by the reactor 8 includes a pump 5. The reactor 8 is surrounded by a tubular jacket 9, and the annular space 7 between the external surface of the reactor and the internal surface of the jacket receives a heated heat exchange medium which heats the oil in the first stage A. The medium is heated in a heat exchanger HE which has an outlet 10 connected to the jacket 9 at the downstream end of the first portion of the path and an inlet 11 which receives spent heat exchange medium at the upstream end of the first portion of the path, i.e., the heat exchange medium flows in the space 7 counter to the direction of the flow of oil from the pump 5 toward the second stage B. Oil which leaves the first stage A is already heated to a temperature of approximately 90° C. so that the first side stream fraction (benzine having a low boiling point) can be evacuated from the discharge end of the first portion of the path to enter a separator 12 and thence a condenser 13.

The heat exchanger (not shown) which raises the temperature of oil in the second stage B to a temperature of approximately 100–115° C. causes the formation of a second side stream fraction including water and azeotropic oils. Such fraction is evacuated by a second separator 12 and is treated in a second condenser 13.

The heat exchanger (not shown) which serves to raise the temperature of oil in the third stage C to 120–150° C. effects the formation of a third side stream fraction (heavy benzine) which is evacuated by a third separator 12 and is immediately processed in a third condenser 13. A fourth heat exchanger serves to heat the oil in the fourth stage D to a temperature of 220–250° C. so that the conveyed oil yields a further side stream fraction (gas oil) which is evacuated by a fourth separator 12 and is immediately processed by a fourth condenser 13. If desired, the stage D can be followed by a further intermediate stage (not shown in FIG. 1) wherein the oil is heated to a temperature which is required to ensure that the oil yields neutral oils. The heat exchanger which serves to supply a heat exchange medium into the annular space between the reactor 8 and the jacket 9 in the stage E heats the oil to a temperature of approximately 300° C. so that the oil yields basic oils. The side stream fractions which are evacuated from the path portions in the stages D and E are condensed in the respective condensers 13 and are thereupon respectively introduced into additional tubular or one-pipe reactors 14 and 15 wherein they are treated in one or more stages in a manner not forming part of the present invention. The treatment in at least one of the additional reactors 14, 15 can involve a hydrogenation of the respective by-product.

The remaining fraction of oil which advances beyond the stage E is heated by an additional heat exchanger corresponding to the heat exchanger HE so that the temperature of oil is raised to coking temperature, i.e., the product which is evacuated in the direction of arrow 18 is or contains coke.

Certain constituents of the conveyed compound deposit along the internal surface of the reactor 8, especially in the last stage F. Therefore, the apparatus which is shown in FIG. 1 preferably comprises means for removing deposits of coke and/or other undesirable deposits from the internal surface of the reactor 8, at least in the last stage F. Such removing means includes a circuit 16 including a pump 17 which circulates an abrasive ingredient concurrent with the flow of oil in the stage F from the fifth to the sixth separator 12 and then back into the upstream end of the last portion of the path. The ingredient which is circulated by the pump 17 is a gas, a liquid or a mixture of both. For example, the cleaning agent can be a liquefied solid substance, such as tin. It is further possible to simply admit the removing agent into the flow of oil so that the oil serves as a carrier of cleaning agent in the selected stage or stages of the reactor 8.

Each condenser 13 can be connected with the respective separator 12 by a return flow conduit or the like. This will be explained in greater detail with reference to the embodiment which is shown in FIG. 2.

The heat exchangers which heat the stream of oil in the stages B to F of the reactor 8 may but need not be identical with the heat exchanger HE for the first stage. Furthermore, the length of all six portions of the path which is defined by the reactor 8 may but need not be the same, and the apparatus of FIG. 1 can further comprise means for maintaining the pressure and the speed of oil in each stage within a preselected optimum range for the development of the respective side stream fraction.

The pump 5 can constitute an injector pump which causes waste oil to enter the reactor 8 in finely atomized condition.

Figure 2:
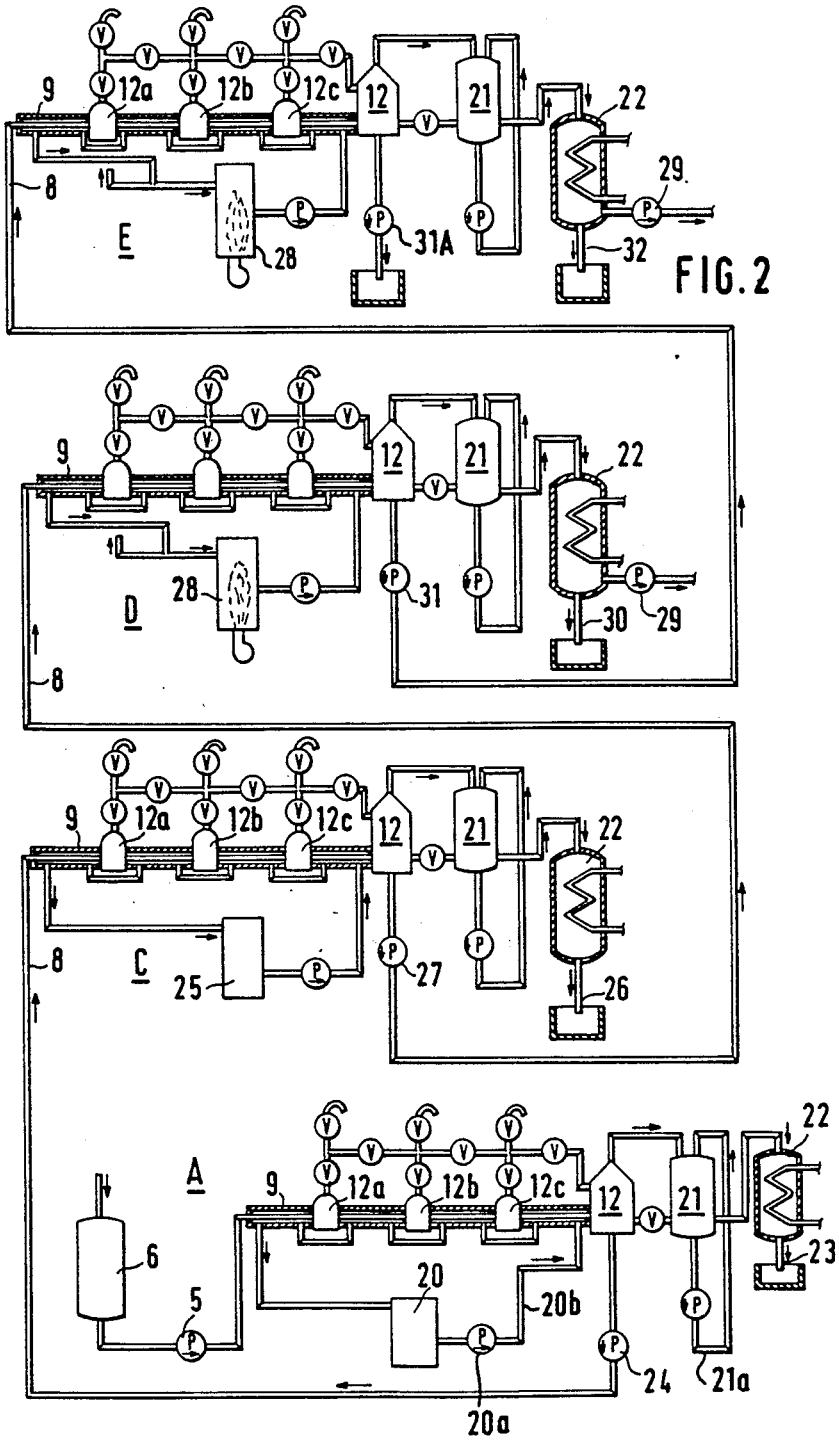
FIG. 2 is a diagrammatic view of a modified apparatus with a four-stage reactor.

FIG. 2 shows a portion of a modified apparatus wherein the tubular or one-pipe reactor 8 defines an elongated path for the treatment of a compound of high molecular weight (e.g., waste oil) in four successive stages A, C, D and E. At least a certain stretch of (but preferably the entire) one-pipe reactor 8 is again spacedly surrounded by a tubular jacket 9 to define therewith an annular space for admission of a heat exchange medium, for example, in a manner as described in connection with and as shown in FIG. 1. The source of waste oil is a tank 6 or another suitable vessel, and a pump 5 is provided to convey a continuous flow of waste oil from the tank 6 into the upstream end of the first portion (stage A) of the elongated path which is defined by the reactor 8. The heat exchange medium is or can include water, and the temperature of oil which reaches the discharge or downstream end of the first portion of the path is at or close to 90° C. The heat exchange medium is preferably circulated in a direction counter to the direction of flow of waste oil from the pump 5 toward the second stage C. The heat exchanger for oil in the first stage is shown at 20; a pump **20*a* is used to circulate hot water in the circuit 20*b*** along an endless path and, as mentioned above, counter to the direction of flow of oil in the stage A.

The means for evacuating side stream fractions from the reactor 8 in the first stage A includes a battery of three separators 12*a*, 12*b*, 12*c* each of which evacuates a particular gaseous fraction, depending on the temperature of oil in the corresponding part of the stage A. The discharge end of the first portion of the path terminates at a main or primary separator 12 which evacuates a particular fraction and admits it into a reflux column 21. The latter circulates the fraction along a path 21*a* and admits the recirculated fraction into a condenser 22 whence the condensed fraction issues in the direction of arrow 23. The condenser 22 condenses oils having a low boiling point and/or water, depending on the temperature of waste oil at the downstream end of the stage A.

A pump 24 is provided to convey the remaining fractions of waste oil from the separator 12 of the stage A into the upstream end of the path portion which is defined by the second stage C. A second heat exchanger 25 is provided to heat oil in the stage C to a temperature of 120–150° C. The heat exchange medium is an oil. Several auxiliary or intermediate separators 12*a*, 2*b*, 12*c* are provided adjacent the path portion which is defined by the stage C to evacuate certain side stream fractions which are released by waste oil at the corresponding temperatures. A main or primary separator 12 at the downstream end of the second portion of the path of waste oil is used to evacuate the corresponding fraction which is admitted into a reflux column 21 whence it enters a condenser 22. The condensate which issues at 26 is heavy benzine.

A further pump 27 is provided to convey the remaining fractions of waste oil from the main separator 12 at the discharge end of the stage C into the upstream end of the path portion which is defined by the stage D. The corresponding heat exchanger is shown at 28, and the stage D has a main or primary separator 12 which admits the fraction to a reflux column 21 whence the fraction enters a third condenser 22 serving to evacuate (as at 30) condensed gas oil. The heat exchanger 28 is or includes a burner which heats a gaseous heat exchange medium serving to heat the oil in the stage D to a temperature of 220–250° C. A vacuum pump 29 is provided to reduce the pressure in the stage D to below atmospheric pressure, preferably to 50–200 mbar. The non-condensible gaseous byproducts which are evacuated by the vacuum pump 29 can be combusted in a manner not shown in FIG. 2.

The stage D can be followed by a further stage (not shown) for segregation and condensation of neutral oil which is withdrawn at a given temperature and is then evacuated by a suitable separator serving to admit such side stream fraction into an associated condenser.

A further pump 31 is provided to convey the residue (bottom product) of waste oil from the separator 12 of the stage D into the upstream end of the path portion which is defined by the stage E. An additional burner 28 serves to heat a gaseous heat exchange medium which raises the temperature of the bottom product to approximately 300° C. A vacuum pump 29 is used to reduce the pressure in the stage E to 1–100 mbar. The main separator 12 of the stage E evacuates a gaseous side stream fraction which is conveyed to the associated separator 22 by way of a reflux column 21. The condensate which leaves at 32 is basic oil.

If desired, the apparatus of FIG. 2 can comprise an additional stage (not shown) wherein the remainder of the bottom product (conveyed from the separator 12 of the stage E) is converted into coke at a pressure of between 1 mbar and 10 bars, preferably at or close to atmospheric pressure. Moreover, the internal surface of the reactor 8 in such additional stage can be relieved of deposits in a manner as described in connection with FIG. 1, e.g., by circulating liquefied metal or by particles of sand. Such agents are capable of removing coke from the internal surface of the reactor 8 to thus reduce the likelihood of clogging and/or unpredictable rates of flow of the bottom product.

Figure 4:
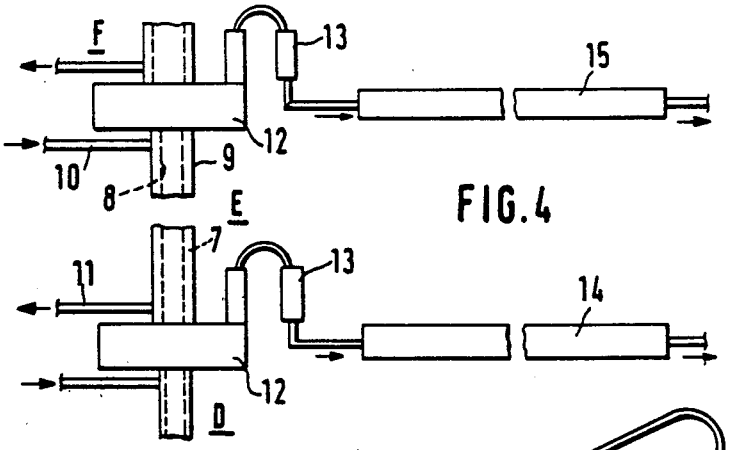
FIG. 4 is an enlarged view of a detail in the apparatus of FIG. 1, showing two tubular side stream reactors which branch off the main reactor.

FIG. 4 shows on a somewhat larger scale the stages D, E and F of the apparatus of FIGS. 1 and 3. The additional or auxiliary tubular or one-pipe reactors 14, 15 can serve to hydrogenate the fractions which are evacuated from the path for waste oil by the respective separators 12. FIG. 4 further shows that the cross-sectional area of the path which is defined by the stages D, E and F in the improved apparatus can increase in the direction of flow of waste oil. The increase of the inner diameter of the reactor 8 can be gradual, or the inner diameter of the reactor can be increased in stepwise fashion.

If the path for waste oil is horizontal or nearly horizontal, especially in the last stage F whose discharge end supplies coke, the likelihood of pronounced deposition of coke along the lower part of the internal surface of the reactor 8 in the stage F can be reduced considerably by agitating the bottom product. To this end, the stage F can be equipped with one or more so-called turbulators which preferably oscillate the reactor about the longitudinal axis by any known means. Alternatively or in addition to one or more turbulators, the reactor portion in the stage F can be provided with one or more constrictions which constitute flow restrictors or throttles and ensure a pronounced agitation of the bottom product. Such bottom product can include coke as well as one or more impurities which are present in waste oil. For example, the reactor portion in the stage F can be provided with a series of successive constrictions. Each such constriction can be obtained in a simple manner by providing the corresponding portion of the reactor 8 with one or more dents so as to reduce the cross-sectional area of the respective portion of the path for coke. Another mode of ensuring the development of turbulence is to impart to the reactor 8 in the corresponding stage an undulate or any other shape which ensures that the bottom product is compelled to repeatedly change the direction of its flow toward the downstream end of the stage F.

The conduits 50 which are shown in FIG. 3 serve to return partially treated waste oil into one or more preceding stages of the apparatus for renewed treatment. It is especially desirable and advantageous to recirculate some waste oil from the downstream end of the last stage into one or more preceding stages inclusive of the upstream end of the foremost portion of the path which is defined by the reactor 8. As a rule, the pressure in the last stage is less than in any preceding stage of the apparatus.

It is further within the purview of the invention to admit one or more agents which serve to remove deposits from the internal surface of the reactor 8 at one or more points ahead of the last stage. For example, sand or another abrasive agent can be admitted with waste oil into the intake end of the first portion of the elongated path which is defined by the reactor 8.

The compound which is being treated need not always be waste oil. Thus, the improved method and the improved apparatus can analogously be used for the treatment of oil obtained by the pyrolysis of waste or of other substances, in particular by the pyrolysis of used tires or waste plastic.

The improved apparatus can be used to heat the stream of waste oil in the reactor in stepwise fashion to a succession of increasingly higher temperatures, for example, in each of the six stages of the apparatus of FIG. 1 and in each of the four stages of the apparatus of FIG. 2. The heating action in each of the stages can be regulated with a high degree of accuracy, not only as concerns the difference between the temperatures of oil at the inlets and outlets of the respective stages but also as concerns the temperatures of oil in different portions of each stage o so that each stage will cause the conveyed stream to yield an accurately defined side stream fraction of two or more discrete fractions (note the auxiliary separators 12*a*–12*c* in each of the stages A, C, D, E shown in FIG. 2). At the same time, the apparatus can ensure that the stream of waste oil will be maintained at a requisite pressure and/or at a required speed to further improve fractionation of the starting product into a desired number of side stream fractions. The conveyed waste oil can be maintained above or below atmospheric pressure. Such treatment in the reactor 8 ensures that the stream of waste oil yields a desired number of accurately defined fractions, and such fractions are immediately segregated (at 12) and processed (as at 13, 14, 15, 21 and/or 22) without delay to yield the desired distilled products.

In contrast to conventional proposals, the apparatus of the present invention treats relatively small quantities of waste oil which is conveyed along its path at an elevated speed. The period of dwell of each unit length of the stream of waste oil in the reactor is very short and can be selected and regulated with a high degree of accuracy and predictability. As used herein, the term "reactor" is intended to denote a device which can constitute a single-tube or one-tube distiller even though at least one chemical reaction will normally (but not always) take place while a quantity of waste oil flows from the inlet toward and into the outlet of the reactor.

Heretofore known tubular reactors are used for continuous polymerization of synthetic plastic materials and for hydrogenation of coal at elevated pressures (to produce fuels). Such procedure involves breaking up and hydrogenation of long molecular chains which can be carried out only at elevated temperatures and pressures. On the other hand, the treatment of waste oil (which should retain its desirable lubricating properties) must be carried out at temperatures and pressures at least slightly below those which could result in a breaking up of molecular chains. Thus, whereas the heretofore known proposals to use tubular reactors involve operations at elevated pressures and temperatures, the present method and apparatus rely on tubular reactors which are operated at temperatures and pressures below those that must be maintained in connection with the polymerization of synthetic plastic materials and/or in connection with the production of flowable fuels from coal. Moreover, whereas the utilization of tubular reactors for the production of flowable fuels as a result of hydrogenation of coal involves the making of an entirely new product, the method and apparatus of the present invention are relied upon to refine and recover a particular product (oil) for the purpose of economizing with such material.

It has been found that the improved method and apparatus ensure a surprisingly high rate of recovery of oil (up to 90 percent, depending on the quality of the material which is supplied by the pump 5), and that the percentage of acid tar is extremely low (normally between 1 and 2 percent). Waste products which are to be disposed of can be used as fuels and/or as chemical additives in the making of cement.

If desired or necessary, waste oil can be preheated prior to admission into the first stage of the reactor 8. This is shown schematically in FIG. 1, as at 106. As already mentioned above, the pressure of conveyed waste oil can be reduced from stage to stage, e.g., down to a final pressure of approximately 1 mbar. This was neither contemplated nor possible in heretofore known apparatus for processing waste oil.

The means for heating the stream of waste oil in various stages of the apparatus can assume any one of a number of forms, depending on the desired extent of heating and/or on the availability of heating materials and equipment. For example, waste oil can be heated by one or more electric heaters including induction and resistance heaters. It is often desirable to rely on indirect high-frequency heating, especially in the last stage (such as the stage F in FIG. 1), in order to reduce the likelihood of accumulation of solid deposits at, and their adherence to, the internal surface of the reactor 8. Heat exchangers operating with a variety of heat exchange fluids (including water, oil and/or others) can be used with advantage as shown in FIGS. 1 and 2, and the flow of such heat exchange fluids in the space 7 between the reactor 8 and the jacket 9 can be in or counter to the direction of flow of waste oil.

In each instance, or at least in a great majority of instances, it is possible to maintain the treated compound at an accurately determined temperature or within an accurately determined temperature range. The reason is that the apparatus conveys small quantities of waste oil at an elevated speed so that a relatively small amount of waste oil in any selected portion of the reactor 8 can be readily heated to and maintained (if necessary) at a predetermined temperature which is best suited to ensure that the conveyed medium will yield the desired side stream fraction or fractions. Otherwise stated, the ratio of heat transfer surfaces to the quantity of waste oil in the respective portions of the reactor 8 is highly satisfactory to thus ensure the establishment and maintenance of desired temperatures or temperature ranges. This, in turn, ensures that conveyed waste oil can yield accurately defined fractions at the downstream ends of successive stages or within one or more stages. The desired temperatures can be selected with a surprisingly high degree of accuracy, namely in the range of 1° C. or even less. Heating with such a high degree of accuracy is not possible in heretofore known apparatus for the treatment of waste oil because conventional apparatus treat large quantities of waste oil per unit of time and the oil is confined in large vessels.

Another advantage of the treatment of relatively small quantities of waste oil at pressures in the range of down to and even below 1 mbar is that the boiling point can be reduced accordingly so that the fractions can be distilled in a gentle manner, i.e., at a lower temperature.

This contributes to the quality of the distillate or distillates.

Still another advantage of the improved method and apparatus is that, since the temperature, velocity and pressure of relatively small quantities of conveyed waste oil can be regulated with a heretofore unmatched degree of accuracy, the likelihood of explosion, fire or other undesirable occurrences is greatly reduced because none of the parameters (such as the temperature and the pressure) can fluctuate within an undesirably wide range which would enhance the likelihood of explosion and/or fire and would necessitate complex and expensive undertakings to ensure and preserve the safety of the plant. The quantity of dangerous substances (such as sodium) which must be admitted in certain stages of the apparatus are small or extremely small because the quantity of conveyed waste oil is small. The danger of explosion and/or fire is reduced on the additional ground that the pressure of conveyed waste oil is or can be reduced (at least in one or more selected stages) well below those pressures which are contemplated or which must be established in accordance with earlier proposals. The consumption of sulfuric acid and bleaching earth is well below the consumption of such substances in conventional apparatus; therefore, the improved method and apparatus are much more acceptable to environmental protection agencies than heretofore known methods and apparatus. Savings in sulfuric acid and bleached earth can amount to between 70 and 90 percent.

A further important advantage of the improved method and apparatus is that the pressure in different stages of the apparatus can vary within a wide range. For example, waste oil in one or more stages can be maintained at or close to atmospheric pressure while the pressure in one or more other stages is well above or well below atmospheric pressure. This renders it possible to carry out chemical reactions on a continuous basis. For example, sodium can be introduced in order to neutralize undesirable chlorine by forming table salt which is evacuated with coke from the last stage of the reactor. Many other chemical reactions which neutralize undesirable ingredients or render it possible to recover valuable ingredients can be relied upon with equal or similar advantage.

As a rule, or in many instances, the temperature in the stage F of the apparatus which is shown in FIG. 1 will be in the range of 300–900° C., and the pressure can be maintained between 1 mbar and 10 bars, preferably at atmospheric pressure. This results in the development of bitumen or coke which is the last product leaving the apparatus and normally contains the majority of contaminants and deleterious ingredients. Such bitumen or coke can be used in the cement industry as fuel and/or as a chemical additive to cement. This renders it unnecessary to resort to a costly and complex disposal of acid tar which is produced in large quantities in accordance with conventional methods and must be disposed of at a high cost for ecological reasons. The extremely small quantity (normally between 1 and 2 percent) of acid tar which is contained in one or more side stream fractions can be converted into or incorporated in coke. The coking operation can take place with or without the admixture of gases. If no coking is contemplated, the substitute product is heavy oil which contains the contaminants and the deleterious ingredients and can be used as a fuel in the cement industry.

Refluxing of some or all of the side stream fractions (as at 21 in FIG. 2) is desirable but optional; it enhances the quality of the side stream fractions. As shown in FIG. 2, the recirculated side stream fraction or fractions can reenter the respective column or columns 21 at or close to the locus of reception of fresh side stream fraction (gas or a mixture of gases and other constituents) from the associated separator 12. Mechanically driven rotor means can be employed to segregate liquid substances from the gaseous phase (e.g., vapors); the thus segregated liquid substances can be admitted into the stream which flows into the next stage or are returned to the sump.

It is further within the purview of the invention to mix the refluxed product or the returned sump product with vaporized oil or with a gas in a portion of the tubular reactor. Gases and/or vapors which are liberated above the refluxed material can be condensed and further processed in a conventional way. The aforementioned additional or auxiliary tubular reactors (if any) can be used for further distilling of the respective side stream fraction or fractions (note the reactors 14 and 15 in FIG. 4). The treatment can be similar to or identical with the treatment or treatments in the main reactor 8, i.e., one or more additives can be supplied in accurately metered quantities while the side stream fraction in the reactor 14 and/or 15 is maintained at an accurately selected temperature, pressure and/or velocity. The treatment in the reactor 14 and/or 15 can be a single-stage or a multi-stage treatment.

Hydrogenation can take place in the reactor 8 and/or in one or more additional tubular reactors. Each additional reactor which is used for hydrogenation is preferably designed in the same way or in at least substantially the same way as the main reactor 8.

Hydrogenation in the main reactor 8 and/or in the reactor 14 and or 15 can be carried out by admitting hydrogen into selected portions of the reactor in such quantities that, for the purposes of hydrogenation, at least 20 percent by weight, preferably at least 30 percent by weight and most preferably at least 35 percent by weight is dissolved in the suspension. In many instances, hydrogenation involves dissolution of hydrogen all the way to saturation of the suspension with hydrogen. For example, a relatively large quantity of hydrogen is introduced during the initial stage of hydrogenation taking into full consideration the aforediscussed provisions regarding the percentage by weight and others. Since hydrogen is actually consumed in the course of the hydrogenating step, it is admitted at one or more locations downstream of the locus of first admission in order to compensate for losses due to consumption. The admission of additional quantities of hydrogen is also carried out taking into full consideration the aforediscussed provisions regarding the percentage by weight and others. The quantities of hydrogen which can be admitted increase in response to a rise of hydrogenating pressure. Thus, the number of loci of admission of additional quantities of hydrogen can be reduced by raising the hydrogenating pressure.

In contrast to conventional autoclave-type hydrogenating apparatus, the tubular reactor 8, 14 and/or 15 is especially suitable for the purposes of cooling, i.e., for withdrawal of heat in the course of the (exothermic) hydrogenating operation. This eliminates the possibility of undesirable and harmful overheating which can take place if the hydrogenation is carried out in an autoclave. The wall of the tubular reactor can transmit the entire reaction heat to a heat exchange fluid which surrounds the reactor, and at least some heat can be recovered from the heat exchange fluid to achieve additional economies.

The hydrogenation can further involve admission, at several spaced-apart locations, of oil which is maintained below hydrogenation temperature. This renders it possible to establish and maintain (when necessary) a uniform temperature along a selected length of the tubular reactor. Such method can greatly enhance the selectivity of the operation. If the average temperature is higher than in conventional autoclave-type hydrogenating apparatus (while the maximum temperature is the same), the hydrogenating operation in the tubular reactor proceeds much faster than in conventional hydrogenating apparatus, i.e., the percentage of recovered oil is higher. The mixture which leaves the reactor enters the separator to yield a liquid fraction and a gaseous fraction; each of these fractions is then processed in a manner which is known and need not be described here.

In order to enhance the transfer of heat, the internal and/or external surface of the wall of the tubular reactor in the apparatus of the present invention can be provided with a single set of threads and helical grooves or with sets of intersecting threads and grooves. Alternatively, or in addition to such configurations, it is possible to provide the internal and/or external surface of the reactor with longitudinally, circumferentially and/or otherwise extending ribs. External ribs are often preferred if the corresponding portion of the tubular reactor is acted upon by a hot gaseous heat exchange fluid. The heating action can be uniformized still further if the pump 5 of FIG. 1 and/or one or more pumps of FIG. 2 (such as 24, 27 and 31) are designed to atomize the stream of waste oil.

The quality of fractions which are recovered from waste oil and the yield can be improved still further if the velocity of waste oil in one or more stages of the tubular reactor 8 (especially in the last stage or in one of the last stages which serve for the development and segregation of side stream fractions) is increased above the initial velocity and by simultaneously increasing the temperature of waste oil for a short interval of time to between 325 and 800° C., i.e., well above the average cracking temperature of 300–320° C. This is possible because the improved method and apparatus allow for a highly accurate regulation of the period of dwell of each unit quantity of waste oil in the interior of the tubular reactor. Such period of dwell can be regulated with a degree of accuracy which is in the range of one or more seconds or even one or more milliseconds. In addition, and as already mentioned above, the period of dwell is extremely short. The accuracy of regulation of the period of dwell will depend upon the extent to which the temporarily raised temperature in one or more portions of the tubular reactor exceeds the cracking temperature. The actual temperature can be several times higher than the cracking temperature because the period of dwell of each unit quantity of waste oil is extremely short and also because the interval of heating to a temperature well above the cracking temperature can be regulated with the aforediscussed high degree of accuracy. It has been found that heating to a temperature of up to 800° C. (or even up to 900° C.) will not entail any undesirable cracking, i.e., the release of hydrogen and splitting of the molecules. The velocity of conveyed waste oil can be raised to and even beyond the speed of sound; this ensures that the period of dwell of unit quantities of waste oil in the tubular reactor is extremely short. As a rule, the speed of waste oil will be increased proportionally with a rise of the temperature above cracking temperature. In other words, the period of dwell is shorter if the temperature of waste oil in one or more selected portions of the tubular reactor is caused to rise above the cracking temperature.

It was further found that the conveyed waste oil undergoes a pronounced agitating action as a result of advancement at a speed which can reach or exceed the speed of sound. Such agitation, in turn, ensures that the temperature is uniform in the corresponding portion or portions of the path for the flow of waste oil. Therefore, the elevated temperature of all carbon molecules in the corresponding portion or portions of the path for waste oil is the same but the short period of dwell does not permit the molecules to acquire the energy which is required for cracking. An advantage of such uniform heating of carbon molecules is that all valuable long-chain molecules remain intact and can be distilled away due to the elevated temperature. This is not possible in accordance with heretofore known proposals to treat waste oil. On the contrary, such valuable long-chain molecules were destroyed at a considerable cost in connection with the disposal of bleached earth. Long-chain molecules in the tubular reactor of the improved apparatus retain their structure so that the recycling results in the recovery of highly valuable raw materials. For example, the treatment of waste oil in accordance with the invention can result in recovery of high-quality lubricating oils which contributes still further to the overall yield. Moreover, the likelihood of contamination of the surrounding atmosphere is greatly reduced and is nil for all practical purposes.

It is also within the purview of the invention to employ a tubular reactor wherein waste oil is treated in a single step following a dehydrating step. The single step can include gradual heating of waste oil to approximately 800° C. and simultaneous acceleration of waste oil to a very high speed, e.g., up to and in excess of the speed of sound. At the outlet end of the stage, the temperature of waste oil is abruptly reduced to a value below the critical cracking temperature. The resulting side stream fractions are segregated one after the other at the corresponding vapor pressures and boiling points and are segregated in a series of steps for the purpose of condensation and/or other treatment. It can be said that the just discussed embodiment of the improved method actually involves "chasing" or "propelling" waste oil through the tubular reactor. The pressure in the reactor is maintained well below atmospheric pressure so that the oil is readily vaporized at a temperature of about 800° C. For example, the length of such reactor can be in the range of 0.2 to 2 km or even greater. Abrupt cooling of the mixture of vapors at the discharge end of such very long path involves a reduction of temperature from approximately 800° C. to less than 300° C. in order to reliably prevent cracking.

Each of the aforediscussed embodiments of the improved method can be said to constitute or involve a lightning fast distillation.

The velocity of waste oil in the tubular reactor 8 can be increased in a number of ways or by relying upon two or more different accelerating techniques. For example, the pump 5, 24, 27, 31 or 31A (FIG. 2, top) can constitute an adjustable pump of any known design which is capable of increasing or reducing the pressure of conveyed waste oil within a desired range. Alternatively, or in addition to the utilization of such pump or pumps, the maker of the apparatus can decide to avoid the utilization of means which would compensate for volumetric increase of waste oil as a result of evaporation in the course of the distilling operation. Alternatively or in addition to the above undertakings, the pump (such as the pump 31A at the top of FIG. 2) can constitute a vacuum pump, or the pressure at the discharge end of a particular stage, of the single stage or of the last stage of a series of stages can be reduced in another suitable way. Still further, the velocity of the stream of waste oil can be increased by admitting into the stream one or more high-speed streams of a liquid and/or gaseous accelerating fluid.

The vacuum pump can be of any known design, e.g., a water ring pump, an oil ring pump, a gas jet pump or a combination of two identical or different pumps. As a rule, such vacuum pump or pumps will be used at the discharge end of the path which is defined by the tubular reactor.

Since the velocity of the stream of waste oil is very high, at least during flow along certain portions of the path which is defined by the tubular reactor, losses due to friction between the flow of waste oil and the internal surface of the reactor can be very pronounced, especially if the velocity of the stream of waste oil approaches or exceeds the speed of sound. In order to counteract such pronounced losses due to friction, it is often advisable to provide or combine the tubular reactor with one or more mechanical oil conveying devices, especially in one or more intermediate portions of the path. For example, a suitable mechanical conveying device can include or constitute a Roots blower, an encapsulated supercharging blower or any other oil conveying arrangement. Such arrangement or arrangements contribute to acceleration of the stream of waste oil and compensate for the aforediscussed losses due to friction between the conveyed oil stream and the reactor.

In accordance with a further embodiment of the invention, the aforementioned abrupt cooling subsequent to heating in a single stage to approximately 800° C. (or any cooling of conveyed waste oil in any other portion of the path where a cooling is necessary or desirable) can be carried out in the reactor proper, preferably in the following way: The rapidly flowing heated stream of oil is caused to impinge upon a barrier which is cooled and is placed across the respective portion of the path (such as the discharge or downstream end of the path in a single-stage tubular reactor). This mode of abruptly cooling successive increments of a rapidly flowing fluid is known as the "Klatch effect" (literally translated as impact, slap, smack or crack effect) and was heretofore utilized solely in the metallurgical industry in connection with the treatment of high-quality metals and alloys. It has been found that the just described mode of abruptly cooling ensures highly predictable and reliable cooling of rapidly flowing heated waste oil to a desired temperature. A barrier which can produce such effect is shown schematically in FIG. 1, as at 51.

Contaminants which are carried by waste oil can be evacuated with the residue, or they are removed from the side stream fractions.

Instead of or in addition to removal of deposits from the internal surface of the reactor in a manner as described in connection with FIG. 1, it is possible to introduce a stream of metallic balls into one or more selected portions of the path which is defined for the stream of waste oil so that the balls roll and/or slide along the internal surface of the reactor and initiate or promote separation of solid matter. Such balls (or otherwise configurated bodies) can be introduced from time to time on a regular or irregular basis or continuously, depending on the tendency of conveyed material to accumulate along the internal surface of the reactor. For example, metallic pellets can be admitted with the stream of waste oil into the upstream end of the first stage A in the reactor of FIG. 1 to advance with waste oil toward and to be evacuated at the discharge end of the stage F or at any location along the path for the stream of waste oil, e.g., immediately upstream of the locus of entry of abrasive ingredients which are circulated by the pump 17. This pump can be designed to circulate one or more abrasive substances at any one of a variety of different speeds or to recirculate the residue (i.e., the product of cracking which is in the form of coke) through the stage F. The circulated substance can be liquefied tin, a salt, sand or a mixture thereof. Though it is possible to provide a means for circulating one or more abrasive substances in any selected stage of the tubular reactor, it normally or often suffices to provide the circulating means 16, 17 only for the last stage where the likelihood of deposition of coke is much more pronounced than in the preceding stages. Since the velocity of residue in the last stage is very high, the admitted abrasive substance or substances form a turbulent flow whose constituents come into repeated contact with eventual deposits of solid material along the internal surface of the reactor 8 and ensure a predictable cleaning and entrainment of separated deposits in the direction of arrow 18. If the turbulence which is caused by the conveyed residue of waste oil does not suffice, the stage F can be equipped with one or more turbulators in the form of baffles or the like and/or the pump 17 or an additional pump can be caused to circulate a gaseous fluid which creates turbulence and thereby enhances the cleaning action of the abrasive substance circulating along the path which is defined by the circuit 16.

Instead of, or in addition to, the aforediscussed methods of and means for cleaning the last stage F of the reactor 8 for the purpose of preventing excessive accumulations of solid deposits including coke and/or contaminants, it is possible to monitor the rate of deposition of solids in the interior of the stage F and to regulate the speed of the residue flowing in this stage as a function of the thickness of the deposit. For example, a beam of radioactive radiation can be directed against a selected portion of the internal surface of the reactor 8 and a Geiger counter or other radiation monitoring means can be provided to detect the quantity of radioactive material which is removed from the irradiated portion of the reactor. A unit which includes a radiation source and a suitable counter, and which is or can be operatively connected to the pump to regulate the pressure of the stream of waste oil entering the stage A, is shown schematically in FIG. 1, as at 55. The signal which is generated by the counter can be compared with a reference signal which is indicative of a desirable rate of cleaning the reactor in the zone F, and the pressure which is generated by the pump 5 (or by a pump which draws air from the discharge end of the reactor 8 at 18) can be regulated accordingly.

Still another method of cleaning one or more selected stages of the improved apparatus can include vibrating the reactor and/or the conveyed stream of waste oil within a satisfactory frequency range which preferably includes resonance frequency. Such vibratory movements can be superimposed in the form of interference vibrations, or they can be obtained as a result of generation of ultrasound or infrasound in the reactor. The oscillations can be effective in the longitudinal direction or transversely of the reactor.

The dimensions of the separators 12 are or can be selected in such a way that they cannot store any appreciable quantities of side stream fractions. Some or all of the separators 12 can constitute rotary separators, e.g., centrifugal separators or disintegrators which are set in motion by prime mover means or by the stream of waste oil or its fraction or fractions.

The pressure in various sections of the reactor can be selected and maintained by the respective pump or pumps (such as the pumps 5, 24, 27, 29, 31 and 31A of FIG. 2) and/or by the provision of suitable valves (some of which are shown schematically in FIG. 3, as at 60). A suitable pressure relief valve can be provided at the discharge end of each stage to prevent the pressure from rising above the desired or optimum value. It is also possible to convey waste oil against manometric heads. Suction pumps can be started at required locations if the pressure in a particular stage rises above the optimum pressure. One of the presently preferred methods of regulating the pressure includes barometric adjustment.

It is normally preferred to design the reactor 8 in such a way that its loops or otherwise configurated sections are substantially horizontal and are disposed at several levels. However, it is equally possible to employ a reactor whose sections are vertical or nearly vertical, e.g., in order to save space or to take advantage of available space. The loops can be used in addition to or in lieu of helical convolutions, and such convolutions can be gathered to form cascades of large numbers of convolutions which are disposed above each other or at or close to the same level. As a rule, the configuration of the reactor 8 will be selected with a view to enhance its compactness without affecting the accessibility of various components which are incorporated in it or are associated therewith.

If desired, one or more auxiliary separators (**12*a*–12*c*) which are shown in the stages A, C, D and E of the apparatus of FIG. 2 can be connected with discrete tubular reactors each of which can include a single stage or two or more stages and whose operation can be identical with or analogous to that of the reactor 8**.

The jacket 9 can but need not have a cross-sectional outline which is identical with or similar to that of the reactor 8. For example, the reactor 8 can constitute a pipe or tube having a circular cross-sectional outline, and the jacket 9 can have a polygonal outline or vice versa. All that counts is to ensure that the parts 8 and 9 jointly define a space which allows for the admission and circulation of requisite quantities of suitable heat exchange medium (such as hot water at elevated pressure, hot oil and/or others) in order, to ensure the aforediscussed highly accurate temperature control of waste oil in the respective sections of the reactor. It has been found that a non-aggressive hot gas is especially suited to ensure predictable heating of waste oil in the corresponding stage or stages of the reactor. Furthermore, total reflection of heat radiation in the space 7 between the reflector 8 and jacket 9 renders it possible to achieve much higher heat exchange coefficients than heretofore.

By way of example, if the reactor 8 is a smooth-surfaced tube, if the temperature of conveyed waste oil in a selected portion of the reactor is 400° C., and if the temperature of a gaseous heat exchange fluid which is used to heat the corresponding portion of the space 7 is 800° C., the heat exchange coefficient K equals 256 $Kcal/m^2$ h° C. (corresponding to 1072 $KJ/m^2$ h° C.). This renders it possible to reduce the area of the heated surface and to increase the reaction speed, i.e., the rate of flow of oil is much higher. This, in turn, contributes to greater compactness of the plant and simplifies the regulation of temperature as well as the controlled admission of additives (such as chemicals and/or others). As mentioned above, the additives can include hydrogen for the purposes of hydrogenation and sodium if the stream of waste oil releases chlorine which is to react with sodium to form salt. Each such additive can be admitted in very accurately metered quantities at an optimum rate and with substantial savings. For example, hydrogenation in accordance with the method and in the apparatus of the present invention can entail savings in hydrogen of 20–25 percent.

Referring again to FIG. 3, several loops of the reactor 8 can be confined in a common jacket (shown schematically at 70) if the temperature of waste oil flowing along one or more selected portions of the path which is defined by the reactor 8 can fluctuate within a reasonably wide range. If some or all straight or nearly straight portions of the reactor 8 are horizontal or nearly horizontal, one or more horizontal or nearly horizontal portions can be arranged to rotate and/or pivot.

Many types of waste oil which are heated to progressively higher temperatures and are conveyed at a progressively decreasing pressure (e.g., down to or even below 1 mbar) will release gaseous fractions at an increasing rate; therefore, the velocity of the stream of waste oil in the reactor 8 increases at a corresponding rate. As a rule, the velocity is between 0.1 and 150 m/sec, preferably between 0.5 and 60 m/sec. In order to regulate the velocity of conveyed waste oil with a desired degree of accuracy, one can rely on the aforediscussed techniques (including changing the pressure of oil which is admitted into the first stage, reducing the pressure at the discharge end of the last stage and others) and/or upon the utilization of a reactor wherein the cross-sectional area of the path for the flow of waste oil and its fractions is not constant all the way from the inlet of the foremost stage to the discharge end of the last stage. This is shown somewhat schematically in FIG. 4 wherein the inner diameter of the reactor 8 increases gradually in the direction of flow of waste oil from stage to stage. Such selection of the inner diameter of the reactor 8 renders it possible to compensate for gradually increasing volume of the conveyed compound so that the velocity equals or closely approximates a value which is sufficiently below the critical value for the selected reactor. If the nature of waste oil which is to be treated in accordance with the invention is such that it releases substantial quantities of one or more gaseous fractions in the very first stage or in the foremost stages of the reactor, the next-following stage or stages can be designed in such a way that the cross-sectional area of the path for the flow of waste oil decreases in the direction of flow.

It is further within the purview of the invention to conform the velocity of waste oil in one or more selected stages, especially in the last stage or stages, to a desired or optimum velocity by mounting two or more tubular sections in parallel and by regulating the temperature and/or velocity of the product in each tubular section independently of the other section or sections. Such mode of operation is especially desirable when the conveyed medium contains a high percentage of gaseous fractions, for example, because the pressure in the respective stages has been reduced to 1 mbar.

Still further, it is possible to influence the sensitivity of the reactor (namely, the ratio of the capacity of a section of the reactor to the heat transfer surface), especially in the foremost stage or stages, by imparting to the section a cross-sectional configuration which departs from a circular outline. For example, the reactor section in the stage A can be flattened so that it has a substantially oval cross-sectional outline. The next-following section of the reactor can exhibit a less pronounced deformation with preferably (but not necessarily) gradual transition into a truly or substantially circular cross-sectional outline. The transition of a more or less pronounced oval outline into a circular outline can take place at the rate at which the percentage of liberated gaseous fractions in the reactor increases.

Two or more of the aforediscussed steps of the improved method and the corresponding structural features of the improved apparatus can be used in any desired combination with each other.

An additional important advantage of the improved method and apparatus is the high processing, treatment and product selectivity of the tubular reactor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of continuously treating waste oil or pyrolysis oil, comprising the steps of conveying the oil along a single elongated path in a tubular reactor; heating the oil to progressively higher temperatures in a plurality of successive portions of said path; maintaining the oil in at least some portions of said path at a pressure and velocity such that the oil yields a succession of fractions as a result of heating, pressurization and periods of conveying along said at least some portions of said path; withdrawing the fractions at the downstream ends of the respective portions of said path; and immediately distilling the withdrawn fractions.

2. The method of claim 1, wherein said maintaining step includes reducing the pressure in successive portions of said path.

3. The method of claim 2, wherein the maintaining step includes reducing the pressure to approximately 1 mbar.

4. The method of claim 1, further comprising the step of hydrogenating at least one fraction within a temperature range of 200–450° C. and at a pressure of 100–300 bars.

5. The method of claim 4, wherein said temperature range is 250–350° C.

6. The method of claim 1, wherein said successive portions include a last portion and said heating step includes establishing in the last portion of said path a temperature within the range of 300–900° C., said maintaining step including keeping the oil in the last portion of said path at a pressure of 1 mbar to 10 bars.

7. The method of claim 6, wherein the pressure in the last portion of said path at at least atmospheric pressure.

8. The method of claim 1, wherein the oil is waste oil; and further comprising the step of injecting waste oil into the first portion of said path so that the oil is admitted into the path in atomized condition.

9. The method of claim 1, wherein said portions include a first and a last portion and at least one intermediate portion; and further comprising the steps of admitting the oil into the first portion of said path at a first velocity, conveying the oil along said intermediate portion at a higher second velocity, and maintaining the oil in said at least one intermediate portion at a temperature of 325–800° C.

10. The method of claim 9, wherein the oil is waste oil having an average cracking temperature of 300–320° C.

11. The method of claim 10, wherein fractionation of the oil is substantially complete upon entry of the oil into said last portion.

12. The method of claim 1, wherein the oil is waste oil; and further comprising the steps of dehydrating waste oil in at least one of said portions, thereafter heating dehydrated waste oil in another portion of said path to a temperature of substantially 800° C. at the downstream end of said other portion, accelerating the oil in said other portion, and abruptly reducing the temperature of accelerated oil to a value below the critical cracking temperature to thus obtain a plurality of fractions, said distilling step including recovering said fractions seriatim at corresponding boiling points and vapor pressures.

13. The method of claim 12, wherein said accelerating step includes accelerating waste oil to the speed of sound.

14. The method of claim 1, further comprising the step of accelerating the oil in at least one of said portions, including pumping the oil into said path.

15. The method of claim 1, wherein said heating step includes vaporizing at least a portion of the oil whereby the oil increases its volume; and further comprising the step of accelerating the oil in at least one portion of said path, including preventing expansion of the vaporized oil.

16. The method of claim 1, further comprising the step of accelerating the oil in at least one portion of said path, including drawing the oil by suction through said at least one portion of the path.

17. The method of claim 1, further comprising the step of accelerating the oil in at least one portion of said path, including recirculating at least part of the oil to said at least one portion.

18. The method of claim 1, further comprising the step of accelerating the oil in at least one portion of said path, including at least one of the following steps:

(a) pumping the oil into said path;

(b) drawing the oil by suction through said at least one portion of the path;

(c) recirculating at least part of the oil to said at least one portion; and (d) vaporizing at least a portion of the oil during said heating step whereby the oil increases its volume, and preventing expansion of the vaporized oil.

19. The method of claim 1, further comprising the step of abruptly cooling the oil in at least one of said portions, including placing a cooled obstruction across said at least one portion of the path so that the oil impinges upon the obstruction.

20. The method of claim 1, further comprising the step of internally cleaning the reactor including removing deposits which accumulate while the heated oil flows therethrough, said removing step including admitting into the oil at least one non-coking abrasive ingredient so that the oil entrains the ingredient at least along a part of said path.

21. The method of claim 21, further comprising the step of regulating said removing step including varying the velocity of the oil in said part of said path to thereby intensify or lessen the abrasive action of said ingredient upon the reactor.

22. The method of claim 22, wherein said regulating step further includes the step of monitoring the percentage of abraded deposits in the oil with a Geiger counter, said varying step including changing the velocity of the oil in said part of said path as a function of the monitored percentage of abraded deposits.

23. The method of claim 1, further comprising the step of vibrating at least a portion of the reactor within a frequency range including resonance frequency to inhibit the formation of deposits in said portion of the reactor.

24. The method of claim 1, further comprising the step of vibrating the oil in at least one of said portions within a frequency range including resonance frequency to inhibit the formation of deposits in said at least one portion.

25. The method of claim 1, further comprising the step of adding to the oil at least one chemically reactive treating agent in at least one portion of said path to remove from the oil a contaminant comprising chlorine.

26. The method of claim 25, wherein said agent is selected from the group consisting of hydrogen and sodium.

27. The method of claim 1, wherein said heating step includes placing a jacket around at least a portion of the reactor and admitting a gaseous heating fluid between the reactor and the jacket.

* * * * *